United States Patent [19]

Kuen

[11] 3,977,458

[45] Aug. 31, 1976

[54] BEAD CURTAINS

[75] Inventor: Ling Kwok Kuen, Hong Kong

[73] Assignee: Lee Loy Plastic Company, Hong Kong

[22] Filed: Apr. 24, 1975

[21] Appl. No.: 571,474

[52] U.S. Cl. ..... 160/332; D6/205

[51] Int. Cl.[2] ..... A47H 1/00

[58] Field of Search ..... 160/332, 338; D45/16 A; D6/205; 63/2; 59/2, 80

[56] References Cited

UNITED STATES PATENTS

| | | | |
|---|---|---|---|
| 1,057,491 | 4/1913 | Morrison et al. | 160/332 |
| 2,884,054 | 4/1959 | Bryant | 160/332 |
| 3,357,204 | 12/1967 | Davis | 63/4 X |

FOREIGN PATENTS OR APPLICATIONS

| | | | |
|---|---|---|---|
| 1,058,183 | 11/1953 | France | 160/332 |

*Primary Examiner*—Philip C. Kannan

*Attorney, Agent, or Firm*—Wenderoth, Lind & Ponack

[57] ABSTRACT

A bead curtain comprises a plurality of strings of beads and a plurality of decorative shells each enclosing a selected one of the beads.

11 Claims, 3 Drawing Figures

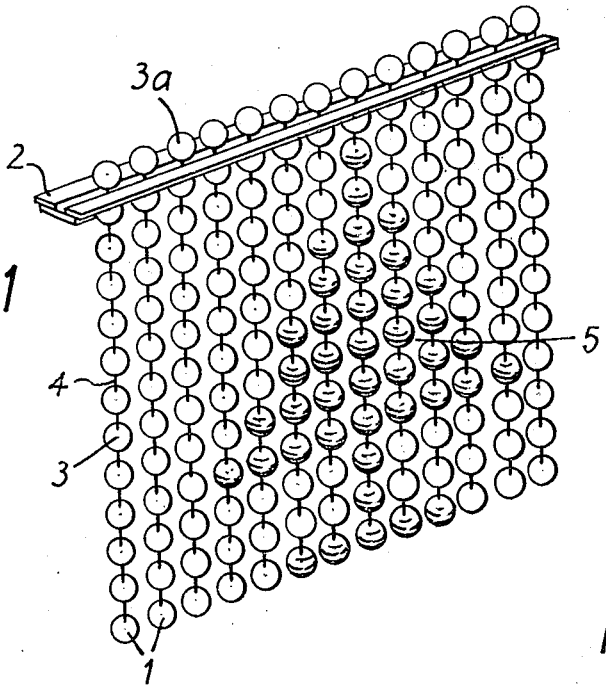
FIG.1
FIG.3
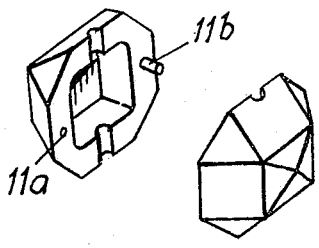
FIG.2
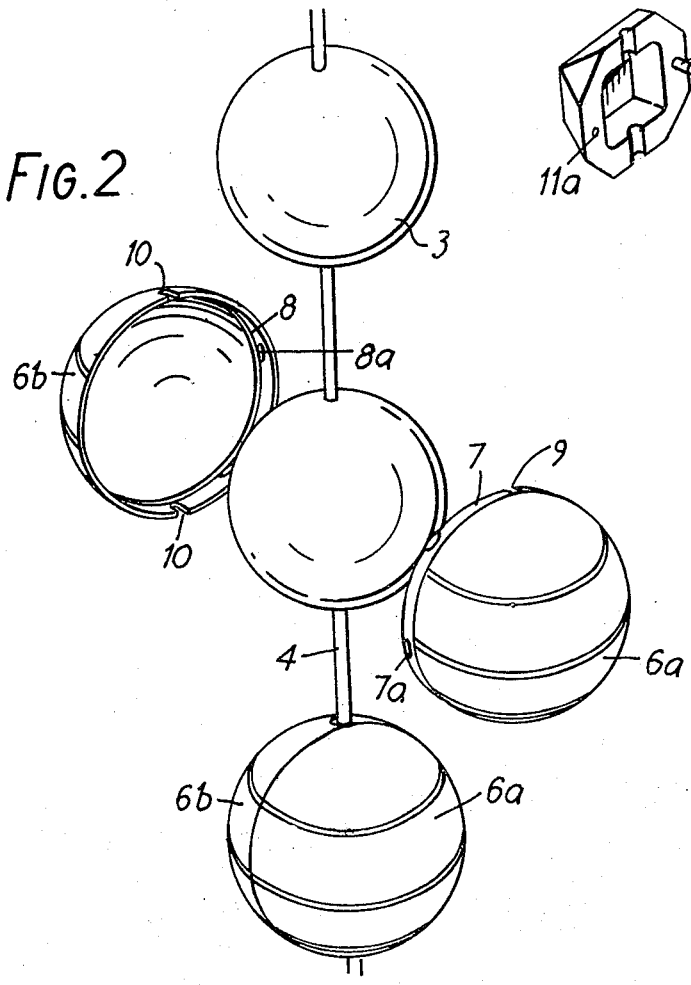

BEAD CURTAINS

This invention relates to bead curtains which, when in use, include a plurality of strings, of similar beads hung side by side.

Such curtains can be used as room dividers, in doorways, in front of windows, or can simply be hung against a wall as decoration.

It has already been proposed that the appearance of such curtains can be brightened by using plastics beads of various colours to create a design or a picture. Alternatively the beads of some curtains have been individually painted, but painting the beads individually requires a lot of patience.

Hitherto when a curtain of coloured beads has been made, the design or picture upon it could only be altered by first unstringing the beads and then restringing them again but in a different order. This process takes a very long time on a curtain made of many small beads and a person changing the design is liable to become bored or to become confused before completing the change. Furthermore if it is intended that a design on the curtain be changeable, then it has not hitherto been posssible to form the strings of beads by moulding the coloured beads directly onto the strings since that would preclude the possibility of unstringing the beads for subsequently changing their order.

It is an object of the present invention to provide a bead curtain in which a design or picture created on it can readily be changed without the need first to unstring the beads.

Accordingly the present invention provides a bead curtain including at least one string of beads and a plurality of decorative shells, adapted each to enclose any selected one of the beads.

The present invention also provides a bead curtain which, when in use, includes a plurality of strings of beads hung side by side from two elongate supporting elements, which trap an end of each string of beads between them, and a plurality of removable decorative shells each enclosing a respective one of the beads. The shells may be of any visual effect (e.g. colour) desired so that a design or picture may be created on the curtain by the use of appropriate shells to cover the beads selected.

The invention also provides a method of decorating a bead curtain having a plurality of strings of beads hung side by side from a supporting means, said method comprising enclosing selected beads each within a respective decorative shell the exterior of the decorative shells differing in appearance from the exterior of the beads enclosed thereby. The shells employed in this method may be of any suitable shape or colour.

The beads of the curtain may be strung on filaments with successive beads in contact with each other or they may be separated by knots in the filament or by spacers. It is, however, preferred that the beads be of plastics material moulded directly on to the filaments to leave a small gap between successive beads. The side by side strings of beads are preferably all attached to a supporting rail which may suitably comprise two elongate elements which trap an upper end of each string of beads between them.

Preferred shells for covering the beads each comprise two hemispheres of coloured thin plastics material, the hemispheres being of a size enabling them to fit closely over the beads. The two hemispheres together will totally enclose a bead and are preferably held together by a press fit male/female connection. This male/female connection may suitably comprise a lip around the rim of one of the hemispheres which is received in a recess around the inside of the rim of the other of the hemispheres so that when the two hemispheres are pressed together, a substantially smooth spherical outer surface will be presented. The lip and recess may additionally be provided with projections and complementary depressions to enable the hemispheres to grip one another securely. To provide a passage through the shell for the filament upon which the bead is strung, the rims of the hemispheres may suitably be indented at diametrically opposed locations.

It is also contemplated that instead of being plain hemispheres, the shells may comprise two co-operating parts of any desired shape, provided always that they can enclose a bead.

In order to create a design or picture on a bead curtain as provided by the invention, the curtain will preferably first be arranged so that the strings of beads hang side by side. Coloured shells will then be fitted on to beads selected and a brightly coloured design can result from the use of appropriately coloured shells. The beads themselves may be of any colour but preferably they will be of a "neutral" colour to provide a background for a design.

An example of a bead curtain in accordance with the invention is shown in the accompanying drawing. In the drawing:

FIG. 1 is a view of the bead curtain;

FIG. 2 is a detail view showing how a decorative shell covers a bead of the curtain; and FIG. 3 is a view of an alternative shell.

In FIG. 1 a plurality of strings of beads 1 are hung from a horizontal supporting rail 2, each string of beads including a plurality of beads 3 moulded directly on to a twisted filament 4 and spaced apart from one another by a gap equal to about half their diameter. The strings of beads are each held by the supporting rail 2 by an uppermost bead **3*a* of the string being trapped above a pair of elongate elements 2*a* and 2*b*. The elements 2*a* and 2*b* are clamped together to leave an elongate gap between them which is too narrow to allow the bead 3*a*** to pass between them.

The beads 3 are all of similar size and colour and although they need not be so, the strings 1 are all of similar length to result in an even overall appearance for the curtain. A design 5 is applied to the curtain by decorative shells 6 of various colours which enclose beads selected as desired.

FIG. 2 shows the form of the shells more clearly. Each shell 6 is of plastics material and comprises a male hemisphere **6*a* and a female hemisphere 6*b*, the internal diameter of each hemisphere being similar to the external diameter of the beads 3. The hemisphere 6*a* has a lip 7 around its rim and the hemisphere 6*b* has a recess 8 around the inside of its rim. The hemispheres 6*a* and 6*b* can be press fitted together to enclose a bead 3 with the lip 7 received closely in the recess 8. The lip 7 of the hemisphere 6*a* is further provided with projections 7*a* which are received in depressions 8*a* in the recess 8 to enable the hemispheres to grip one another securely when press-fitted together. The rims of the hemispheres are also indented at 9 and 10 to provide clearance for the filament 4 when the hemispheres are pressed together. Removal of the shell is effected simply by prising the hemispheres 6*a* and 6*b*** apart.

If it is intended that the shells should provide a permanent design upon the curtain, the two hemispheres may additionally be secured together and/or to the respective bead by a suitable adhesive or by welding.

The shells themselves may be of any size, shape or colour provided always that they can be fitted on to the beads selected. FIG. 3 shows an example of an irregularly shaped shell which encloses a bead within a non-circular cavity and is held together by a plug and socket male/female connection 11*a* and 11*b*.

I claim:

1. A bead curtain including at least one string of beads and a plurality of decorative shells each removably enclosing any selected one of the beads.

2. A bead curtain as claimed in claim 1 in which the shells each comprise two complementary elements adapted to be fitted together to enclose any selected one of the beads.

3. A bead curtain as claimed in claim 2 in which the complementary elements of each shell comprise two hemispheres of plastics material of a size enabling the shell to fit closely over any selected one of the beads.

4. A bead curtain as claimed in claim 3 in which the two hemispheres of each shell can be fitted together and held together by a press-fit male/female connection.

5. A bead curtain as claimed in claim 4 in which the male/female connection comprises a lip around the rim of one of the hemispheres adapted to be received in a complementary recess around the inside of the rim of the other of the hemispheres.

6. A bead curtain as claimed in claim 5 in which the lip and complementary recess are further provided with complementary projections and depressions whereby when the lip is received in the recess, the projections of one hemisphere are received and gripped in the depression in the other hemisphere.

7. A bead curtain as claimed in claim 3 in which the rims of the hemispheres are indented at diametrically opposed locations to provide a passage for a filament upon which said selected bead is strung.

8. A bead curtain as claimed in claim 1 in which each string of beads comprises a plurality of beads of plastics material moulded directly onto a filament, successive beads on the filament being spaced apart to leave a gap therebetween.

9. A bead curtain as claimed in claim 1 in which at least some of the shells have a different visual effect from others of the shells.

10. A bead curtain which, when in use, comprises a plurality of strings of beads hung side by side from two elongate supporting elements which trap an end of each string of beads between them, and a plurality of removable decorative shells each enclosing a respective one of the beads.

11. A method of decorating a bead curtain including a plurality of strings of beads hung side-by-side from a supporting means, the method comprising enclosing selected beads each within a respective decorative shell, the exterior of the decorative shells differing in appearance from the exterior of the beads enclosed thereby.

* * * * *